United States Patent [19]

Thomas

[11] 4,347,119

[45] Aug. 31, 1982

[54] HORIZONTAL OIL SHALE AND TAR SANDS RETORT

[76] Inventor: Delbert D. Thomas, 313 High St., Redlands, Calif. 92373

[21] Appl. No.: 208,946

[22] Filed: Nov. 21, 1980

[51] Int. Cl.[3] ..... C10G 1/02; C10B 47/18; C10B 53/06

[52] U.S. Cl. ..... 208/11 R; 208/8 R; 202/117; 201/15

[58] Field of Search ..... 208/8 R, 11 R; 202/90, 202/108, 117, 118, 151

[56] References Cited

U.S. PATENT DOCUMENTS

| | | | |
|---|---|---|---|
| 868,026 | 10/1907 | Smith | 202/90 |
| 1,423,527 | 7/1922 | Johns | 208/11 R |
| 1,541,404 | 6/1925 | Smith | 202/117 |
| 1,916,900 | 7/1933 | Vandegrift et al. | 202/131 |
| 2,290,806 | 6/1942 | Hodgen | 202/118 |
| 2,434,815 | 1/1948 | Shaw | 202/16 |
| 2,560,767 | 7/1951 | Huff | 202/15 |
| 3,148,128 | 9/1964 | Fagnant | 202/129 |
| 3,556,947 | 9/1968 | Kumper | 202/151 X |
| 4,094,769 | 6/1978 | Brown | 208/11 R |
| 4,146,460 | 3/1979 | Thomas | 208/11 R |
| 4,277,316 | 7/1981 | Taylor | 203/99 |

*Primary Examiner*—Delbert E. Gantz
*Attorney, Agent, or Firm*—Poms, Smith, Lande & Rose

[57] ABSTRACT

A horizontal retorting apparatus and method designed to pyrolyze tar sands and oil shale, which are often found together in naturally occurring deposits. The retort is based on a horizontal retorting tube defining a horizontal retort zone having an upstream and a downstream end. Inlet means are provided for introducing the combined tar sands and oil shale into the upstream end of the retort. A screw conveyor horizontally conveys tar sands and oil shale from the upstream end of the retort zone to the downstream end of the retort zone while simultaneously mixing the tar sands and oil shale to insure full release of product gases. A firebox defining a heating zone surrounds the horizontal retort is provided for heating the tar sands and oil shale to pyrolysis temperatures. Spent shale and tar sands residue are passed horizontally beneath the retort tube with any carbonaceous residue thereon being combusted to provide a portion of the heat necessary for pyrolysis. Hot waste solids resulting from combustion of spent shale and tar sands residue are also passed horizontally beneath the retort tube whereby residual heat is radiated upward to provide a portion of the pyrolysis heat. Hot gas inlet holes are provided in the retort tube so that a portion of the hot gases produced in the heating zone are passed into the retort zone for contacting and directly heating the tar sands and oil shale. Auxiliary heating means are provided to supplement the heat generated from spent shale and tar sands residue combustion in order to insure adequate pyrolysis of the raw materials with varying residual carbonaceous material.

15 Claims, 4 Drawing Figures

HORIZONTAL OIL SHALE AND TAR SANDS RETORT

BACKGROUND OF THE INVENTION

The present invention relates generally to apparatus and methods for retorting oil shale and tar sands. More specifically, the present invention relates to an apparatus and method which may be utilized to pyrolyze oil shale and tar sands individually or in varying combinations with a high degree of economy and efficiency.

Since the beginning of modern industrialized society, man's dependence on petroleum for meeting energy demands has increased continually. At the same time, the known resources of petroleum reserves have dwindled. Increased energy demands coupled with dwindling oil reserves has resulted in a massive and concerted effort to develop alternative energy sources. One of the primary alternative sources of energy presently under consideration is oil and combustible gases derived from oil shale and tar sands. Although the present known reserves of oil shale and tar sands are substantial, there has yet to be a commercial implementation of an apparatus and method which can economically and reliably produce usable products from tar sands and oil shale at a competitive price.

Oil shale is a compact sedimentary rock which yields twelve to sixty gallons of oil per ton. The oil-producing substance present in oil shale occurs naturally as kerogen. Kerogen is a complex organic material which may be pyrolyzed at elevated temperatures in the neighborhood of 1000° F. to form shale oil. The requirement that kerogen be heated to high temperatures to recover oil from oil shale has resulted in the use of retorting apparatus to carry out the pyrolysis of kerogen within oil shale. Tar sands, although not containing kerogen, must also be heated to elevated temperatures to recover usable oil products from the tar contained within tar sands. In order to recover oil from tar sands, the temperature must be raised to about 500° F.

Since tar sands and oil shale are many times encountered in the same geologic structure, with major tar sands deposits frequently including "lenses" or layers of oil shale, it is most desirable that a given retort apparatus system be capable of handling both oil shale and tar sands individually and also in combination. A retort apparatus for providing economical and energy efficient retorting of oil shale is disclosed in my prior U.S. Pat. No. 4,146,460 issued on Mar. 27, 1979. Although this apparatus is well-suited for retorting oil shale, the inclined nature of the retort requires that energy be expended when the raw oil shale and tar sands are conveyed upward or elevated to the inlet end of the retort. There is a continuing need for retort designs which are more energy efficient, simple in operation, reliable and economic to use.

SUMMARY OF THE INVENTION

The present invention provides a unique positive drive substantially horizontal retorting apparatus and method designed to pyrolyze both tar sands and oil shale, either separately or combined, efficiently and economically.

The present invention is based on a retorting tube defining a generally horizontal retort zone having an upstream end and a downstream end. Inlet means are provided for introducing tar sands and oil shale into the upstream end of the retort zone. A screw conveyor horizontally conveys tar sands and oil shale from the upstream end of the retort zone to the downstream end of the retort zone while simultaneously mixing the tar sands and oil shale to insure optimum release of product gases. A fire box defining a heating zone surrounding the horizontal retort is provided for heating of the tar sands and oil shale to pyrolysis temperatures.

One feature of the present invention involves the use of a horizontal conveyor belt or stoker grate arrangement located below the retort tube for conveying spent shale and tar sands residue from beneath the downstream end of the retorting zone to beneath the upstream end of the retorting zone. The spend shale and tar sands residues are the solid materials remaining after pyrolysis of oil shale and tar sands. These solid residues contain between 5 and 10% by weight carbonaceous material. In accordance with this feature of the invention, as the tar sands and oil shale are conveyed transversely beneath the retort zone, the carbonaceous material is combusted with air or other oxygen containing gas to provide at least a portion of the heat necessary to raise the tar sand and oil shale within the retort zone to pyrolysis temperatures. The hot combustion gases resulting from combustion of carbonaceous residues on the spent shale and tar sands flow around the retort tube to indirectly heat the tar sands and oil shale contained therein.

In accordance with another feature of the present invention, hot gas inlet holes are provided in the retort tube so that a portion of the hot gases produced in the heating zone are passed into the retort zone for contacting and directly heating the tar sands and oil shale.

In accordance with additional aspects of the present invention, the shale ash and sand remaining after combustion of the spent shale and tar sands residue is continually conveyed off of the upstream end of the stoker grate conveyer where it falls onto a horizontal solid waste conveyor. The solids waste conveyor may be either a conveyor belt or screw type conveyer which conveys the hot shale ash and sand from beneath the upstream end of the retort tube and stoker grate conveyer to beneath the downstream end of the retort zone and stoker grate conveyer. As the waste solids are horizontally conveyed on the waste solids conveyer, they radiate at least a portion of their residual heat upward to supplement heating of the retort tube. The partially cooled waste solids are then removed from the retort and passed to a suitable waste dump. The screw conveyor which is provided for mixing and conveying the tar sands and oil shale horizontally through the retort zone includes as a feature of the present invention longitudinal mixing bars parallel to the central axis of the screw conveyer which additionally mix the tar sands and oil shale to further optimize production of product gases and oil. These mixing bars may also be in close proximity to the inner cylindrical walls of the retort tube to preclude sticking or the build-up of deposits at the heated retort wall.

The provision of a supplemental burner in the fire box is a collateral feature of the invention; and this provides flexibility in the maintenance of desired operating temperatures as the amount of residual combustible material in the combined tar sands and oil shale varies.

The above-discussed and many other features and attendant advantages of the present invention will become apparent as the invention becomes better understood by reference to the following detailed description when considered in conjunction with the accompanying drawings.

DETAILED DESCRIPTION OF A PREFERRED EXEMPLARY EMBODIMENT

Figure 1:
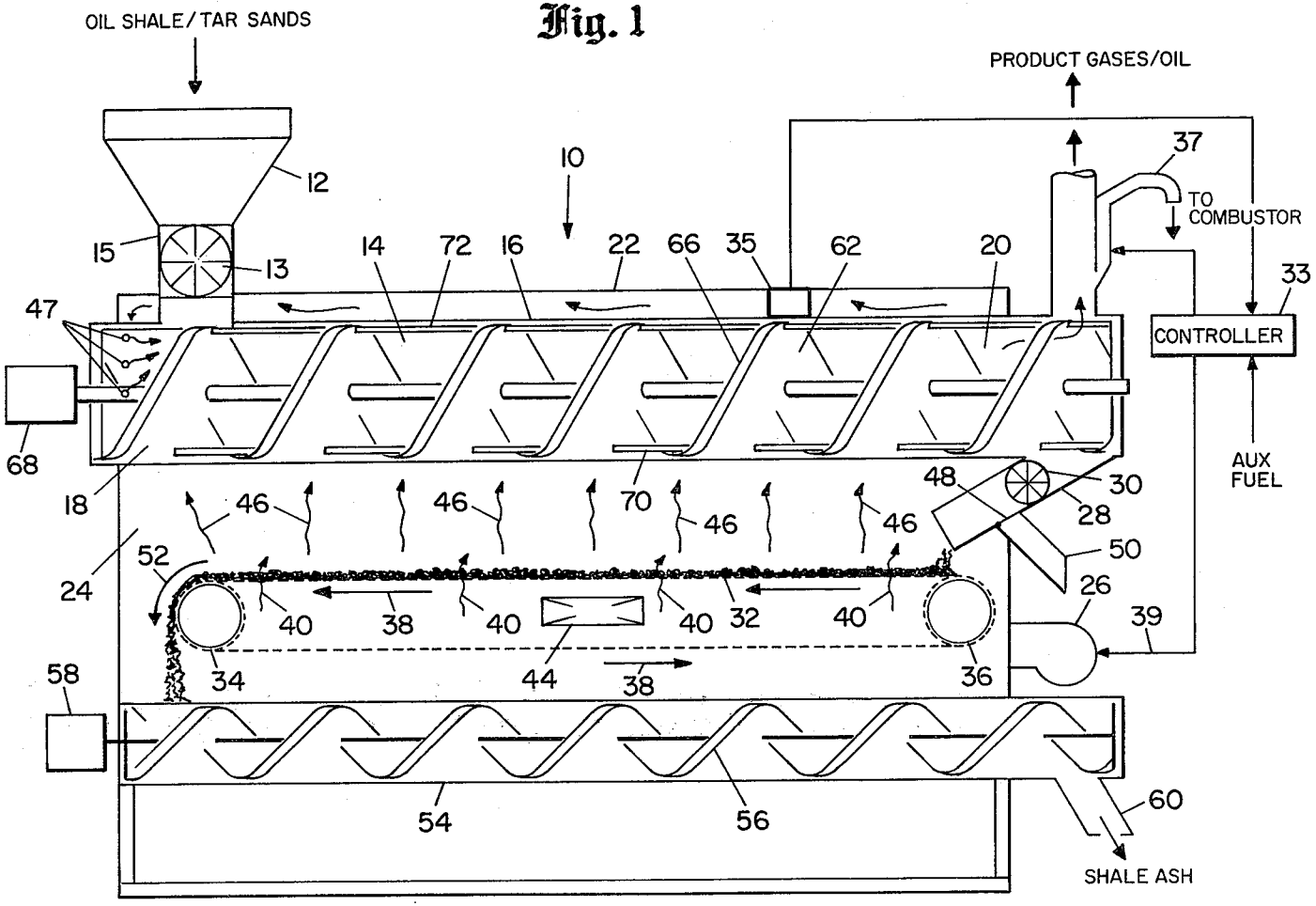
FIG. 1 is a simplified diagrammatical side view of an exemplary horizontal retort in accordance with the present invention.

Referring first to FIG. 1, the horizontal retort in accordance with the present invention is shown generally at 10. The retort 10 is designed for retorting tar sands, oil shale and other carbonaceous materials such as coal and peat. The retorting of tar sands and oil shale is particularly contemplated and preferred. Both tar sands containing varying amounts of oil shale and tar sands alone may be pyrolyzed in the horizontal retort. Additionally, oil shale alone without tar sands being present may also be pyrolyzed.

The horizontal retort includes an input hopper 12. The input hopper 12 is funnel shaped to receive tar sands, tar sands and oil shale, and oil shale alone. The raw materials are preferably comminuted to a particle size of under two to three inches. A rotary valve 13 is provided for controlling the input rate of raw materials into the retort tube 16. The rotary valve 13 is sealed within input channel 15 to prevent escape of valuable product gases and oils out of the retort tube 16. The retort tube 16 defines a retort zone 14. The retort zone 14 includes an upstream end 18 and a downstream end 20.

The retort tube 16 is mounted horizontally within the horizontal frame structure 22. The retort tube 16 does not rotate and is therefore securely fixed to the frame structure 22. The horizontal frame structure 22 provides an enclosed heating zone 24 which surrounds the retort tube 16. As the tar sands and oil shale are passed horizontally through the retort zone 14, the heating zone 24 is heated to temperatures required for pyrolysis. This heat for pyrolysis may be supplied in two ways. First, combustor 26 is provided for supplying all or a portion of the heat necessary to carry out retorting. The cumbustor 26 is fueled by auxiliary or alternative liquid fuels or gaseous fuels. The second source of heat for pyrolysis is supplied by combustion of the carbonaceous residues remaining on the spent shale and tar sands after pyrolysis. The heating process will be described in detail below.

The spent shale and tar sands residue are passed out of the restort zone 14 through output channel 28. An output rotary valve 30 is placed within output channel 28 to regulate the flow of spent shale and tar sands residue from the retort zone 14. The output rotary valve 30, like the rotary valve 13 is sealed within output channel 28 to prevent the escape of valuable product gases and oil.

Figure 4:
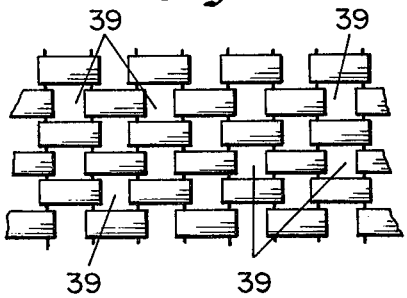
FIG. 4 is a view of a preferred stoker grate belt.

The spent shale and tar sands residue flow by gravity down the output channel 28 and onto stoker grate or conveyer belt 32. The conveyer belt 32 is mounted on pulleys 34 and 36. The pulleys 34 and 36 are driven by suitable motors (not shown) in a counterclockwise direction. The counterclockwise rotation of pulleys 34 and 36 drives the conveyer belt 32 in the direction shown by arrows 38. The conveyer belt 32 is a continuous belt which preferably is made from a mesh material as shwon in FIG. 4. The conveyer belt can be made from any suitable, relatively flexible, metal grating or other heat resistant material. The mesh openings 39 should be of a suitable size to allow the passage of combustion air up through the mesh openings 39 as shown by arrows 40. On the other hand, the mesh openings 39 must be sufficiently small to prevent large amounts of spent shale and tar sands residue from falling through the conveyer belt 32 during combustion. The pulleys 34 and 36 are placed at a suitable distance apart so that a conveyor belt 32 of suitable size when mounted thereon will extend almost the entire length of the retort tube 16. The tar sands residue and spent shale are shown at 42 as they are conveyed horizontally across the conveyer belt 32. Combustion air is introduced through air inlet 44 to provide sufficient air for burning any remaining carbonaceous materials on the spent shale and tar sands residue. Typically, spent shale will contain from 1 to 5% carbonaceous material while tar sands will generally contain very little if any carbonaceous materials. The spent shale and tar sands residues travelling across the conveyer belt 32 are at an elevated temperature due to prior retorting in retort zone 14. It is therefore only necessary to add combustion air by way of air inlet 44 to accomplish combustion of the carbonaceous residues. The heat generated from this combustion of the carbonaceous residue on spent shale and tar sands is radiated upward as represented by arrows 46. The hot combustion gases from the carbonaceous residue combustion contacts the retort tube 16 to provide indirect heating of the oil shale and tar sands within the retort zone 14. The hot combustion gases flow up and around the retort tube 16. Hot gas inlet ports 47 are provided in the retort tube 16 to allow introduction of the radiated hot combustion gases directly into the retort zone 14. This allows direct contact of the hot combustion gases with the tar sands and oil shale for increased heat transfer and improved heating.

As will be realized, it is important to regulate the oxygen content of the hot combustion gases radiating from the spent shale and tar sands residue. If the oxygen content of these combustion gases is too high, the hot combustion gases entering the retort zone 14 through hot gas inlets 46 would cause combustion of the valuable product gases and oil within the retorting zone 14 and result in overheating of the retort. A combustion air regulator (not shown) is therefore provided to regulate the amount of combustion air introduced through air inlet 44 during combustion of carbonaceous residues on the spent shale and tar sands. When tar sands alone are retorted, very little if any carbonaceous residue remains on the tar sands residue. Combustion air input through air inlet 44 should therefore be kept at a minimum during retorting of tar sands only. When tar sands having oil shale mixed therein are retorted, the amount of combustion air introduced through air inlet 44 may be raised to provide approximately the stoichiometric amount of oxygen necessary to combust the carbonaceous material present on the tar sands and oil shale. Although tar sands themselves may not contain any appreciable amount of carbonaceous material after retorting, by their intermixing with oil shale during retorting, a certain amount of carbonaceous material is expected to be present on the surface of the tar sands residue. Preferably, sufficient air is introduced through air inlet 44 to combust all of the carbonaceous material present on the spent shale and tar sands residue with the hot combustion gas having a final oxygen content of less than 3%. When oil shale alone is being retorted, the amount of combustion air passed through air inlet 44 may be kept at a maximum to insure complete utilization of all of the carbonaceous material present on the spent shale for heating of the retort zone 14. Again, the final hot combustion gas should contain less than 3% oxygen.

When tar sands alone are being retorted, it may be desirable to completely bypass the combustion of the residue on conveyer belt 32. In this case, bypass valve 48 is provided which may be opened to transfer the flow of tar sands residue from output channel 28 to bypass chute 50. This allows immediate removal of the tar sands residue from the retort to downstream heat recovery and further processing. In this situation, the combustor 26 must be provided with sufficient fuel and air to provide all of the heat necessary to retort the tar sands present in the horizontal retort zone 14.

In typical operation, the amount of oil shale present in the tar sands will vary. This results in a continual variation of heat available from combusting carbon residues on the conveyor belt 32. Preferably, a control box 33 is provided to regulate the amount of auxiliary fuel and oxygen supplied to combustor 26 to insure that sufficient heat is generated to keep the temperature of the retort zone 14 at desired pyrolysis temperatures. A temperature sensor 35 is provided which actuates the control box 33 to provide auxiliary fuel when the temperature of the retort zone 14 falls below about 900° F. for tar sands/oil shale mixtures and below 500° F. for tar sands alone. The control box when actuated may siphon off fuel from the retort zone by operating valve 37. This will recycle a portion of the product gases leaving the retort zone 14 to the combustor 26 for use as a fuel. During start up operations and at other times when the use of retort product gases and oil is either impractical or not desirable, the control box 33, when actuated by sensor 35 will introduce auxiliary fuel to the combustor 26 through line 39.

Although all of the heat necessary for retorting of tar sands must be supplied by combustor 26, it should be noted that the temperature of pyrolysis for tar sands is relatively low and in the neighborhood of 500° F. When tar sands having oil shale mixed therein are retorted, even though increased carbonaceous material residues are available for combustion on conveyor belt 32, the temperature of retorting must be accordingly increased to around 1000° F. to insure pyrolysis of the kerogen present in the oil shale. Therefore, even though the carbonaceous material from spent shale may be combusted to provide heat for retorting, the combustor 26 may be necessary to supply a portion of the retorting heat even for mixtures of tar sands having large amounts of oil shale.

Arrow 52 depicts the combusted spent shale and tar sands residue falling off of the conveyer belt 32 beneath the retort upstream end. The combusted spent shale and tar sands residue includes mainly shale ash and sand. This hot shale ash and sand falls onto waste conveyor 54. The waste conveyor 54 is preferably a conventional screw-type conveyor. The waste conveyor 54 includes a transfer screw 56 which is driven by gear motor 58 so as to horizontally transport the shale ash and sand to waste output 60. A standard conveyor belt could also be used equally well for this purpose. By transferring the hot shale and sand horizontally from a position below the upstream end of the retort tube 18 to the downstream end 20 of the retort tube, a portion of the heat contained in the waste solids is radiated upward to additionally provide heat for pyrolysis. Any heat remaining in the waste solids after removal through waste output 60 is conveniently utilized for other heat requirements within the processing plant.

Figure 2:
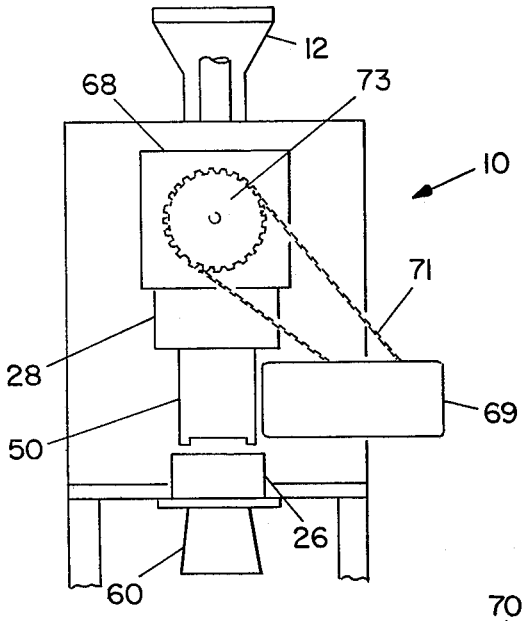
FIG. 2 is an end view of FIG. 1 taken showing the gear drive in more detail.
Figure 3:
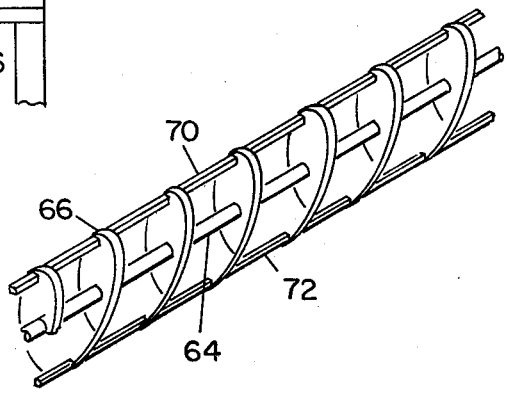
FIG. 3 is a detailed view of a preferred screw conveyer and mixing bars for use in the retort tube.

In accordance with the present invention, a screw conveyor 62 is provided for conveying the tar sands and oil shale horizontally from the retort zone upstream end 18 to the retort zone downstream end 20. The screw conveyor 62 simultaneously mixes and horizontally conveys the tar sands and oil shale. The screw conveyor 62 includes a central screw shaft or axle 64. The screw axle 64 has a screw conveyor surface 66 integral with the screw shaft 64 or suitably mounted thereon. Preferably, the screw shaft 64 and screw conveyor surface 66 are fabricated from a suitable metal such as high temperature steel or the like. The screw conveyor surface 66 may be made of sheet metal suitably secured to the axle 64. The screw axle 64 is suitably mounted within the retort tube 16 so that it rotates freely. A gear drive shown diagramatically at 68 is provided for rotating the screw conveyor 62. In FIG. 2, a preferred gear drive is shown having a driving motor 69 a chain 71 for driving gear 73 which in turn drives screw conveyor 62. As best shown in FIG. 3, the screw conveyor is provided with two longitudinal mixing bars 70 and 72. Although only two mixing bars 70 and 72 are shown, any number of mixing bars may be utilized. The mixing bars are positioned close to the radially outward edges of the screw conveyor surface 66 so that they not only mix the tar sands and oil shale but provide a certain degree of scraping of the tar sands and oil shale away from the retort tube inner surface. This reduces caking and clogging within the retort tube 16. The screw conveyor 62 is rotated in the appropriate direction to provide screw-type conveying of the tar sands and oil shale horizontally through the retort zone 14. By utilizing the screw-type design along with mixing bars 70 and 72, not only is horizontal conveyance of the oil shale and tar sands carried out, but any large tar sand or oil shale clumps are comminuted. In addition, the enhanced mixing provided by such a design increases heat exchange with hot gases introduced through inlets 46 and optimizes product gas and oil release.

The substantially horizontal configuration of the above-described retort does away with the need for elevator systems to carry raw tar sands and oil shale up to an elevated raw material input as disclosed in U.S. Pat. No. 4,146,460 which was previously discussed. In addition, the unique combination of stoker grate belts and waste conveyor belts located beneath the retort tube provides for increased utilization of process heat and carbonaceous residues.

Having thus described exemplary embodiments of the present invention, it should be noted by those skilled in the art that the within disclosures are exemplary only and that various other alternatives, adaptations and modifications may be made within the scope of the present invention. Accordingly, the present invention is not limited to the specific embodiment as illustrated herein.

What is claimed is:

1. A method for retorting carbonaceous materials including tar sands and/or oil shale in a substantially horizontal retort comprising the steps of:

introducing carbonaceous material having varying proportions of tar sand and oil shale, into a substantially horizontal retort tube having a retort zone, said retort zone having an upstream end and a downstream end;

conveying said carbonaceous material substantially horizontally through said retort zone and simultaneously mixing said carbonaceous material;

heating said carbonaceous material in said retort zone to a temperature sufficient to pyrolyze said carbonaceous material to form product gases and oil and pyrolysis residue;

conveying the pyrolysis residue substantially horizontally beneath said retort zone while combusting any carbonaceous material in said pyrolysis residue to produce at least a portion of the heat for heating said retort tube, with the amount of heat produced by such combustion varying with the composition of said carbonaceous material, said combustion also producing hot waste solids;

supplying additional fuel for combustion in the zone beneath said retort to supplement the heat provided by the combusting of said carbonaceous material selectively to raise the temperature of the retort to the desired retorting levels; and disposing of the waste combustion products.

2. A method according to claim 1 for retorting oil shale only wherein the heat necessary to pyrolyze said oil shale is provided substantially by combustion of spent shale during horizontal conveyance beneath said retort zone.

3. A method according to claim 1 wherein the hot waste solids are removed from said horizontal retort by conveyance horizontally beneath said spent shale and tar sands residue from the retort zone upstream end to the retort zone downstream end whereby residual heat in the hot waste solids is radiated upward to provide a portion of the heat for heating said retort zone, said partially cooled hot waste solids being removed from the retort below the retort zone downstream end.

4. A substantially horizontal retort adapted to pyrolyze carbonaceous material at elevated temperatures to produce product gases and oil and pyrolysis residue comprising:

a substantially horizontal retort tube defining a retort zone and having an upstream end and a downstream end;

inlet means for introducing carbonaceous material into the upstream end of said retort zone;

screw conveyor means for simultaneously mixing and conveying said carbonaceous material from said retort zone upstream end to said retort zone downstream end;

means for heating said carbonaceous material to a temperature sufficient to pyrolyze said carbonaceous material to form said product gases and oil and pysolysis residue;

product gas and oil removal means for removing said product gases from said retort zone;

solids removal means for removing pyrolysis residue from said retort zone;

said means for heating said carbonaceous material including a fire box surrounding said horizontal retort; and including means for heating said retort tube directly, both by radiant heat from combustion, and by convection thereby encompassing said retort tube in an intense heating zone; and travelling grate means for receiving said pyrolysis residue from said solids removal means and for transporting it under said retort within said fire box while said pyrolysis residue from the carbonaceous material is burning.

5. A substantially horizontal retort according to claim 4 wherein said means for heating the carbonaceous material further includes hot gas inlet means associated with said retort tube for introducing hot gases from said heating zone into said retort zone to directly heat the carbonaceous material.

6. A substantially horizontal retort adapted to pyrolyze carbonaceous material at elevated temperatures to produce product gases and oil and pyrolysis residue comprising:

a substantially horizontal retort tube defining a retort zone and having an upstream end and a downstream end;

inlet means for introducing carbonaceous material into the upstream end of said retort zone;

screw conveyor means for simultaneously mixing and conveying said carbonaceous material from said retort zone upstream end to said retort zone downstream end;

means for heating said carbonaceous material to a temperature sufficient to pyrolyze said carbonaceous material to form said product gases and oil and pyrolysis residue;

product gas and oil removal means for removing said product gases from said retort zone;

solids removal means for removing pyrolysis residue from said retort zone;

a fire box defining a heating zone surrounding said horizontal retort;

means for heating the gases within said heating zone to indirectly heat the carbonaceous material by heating said retort tube;

stoker grate means disposed in said heating zone below said retort tube for conveying hot pyrolysis residue horizontally from near the retort tube downstream end to near the retort tube upstream end;

combustion means for combusting carbonaceous residue present in said pyrolysis residue to produce hot gases and waste solids whereby at least a portion of the heat necessary to pyrolyze said carbonaceous material is provided;

means for transferring the pyrolysis residue from the retort zone to said stoker grate means; and solids where removal means for removing the waste solids from the heating zone.

7. A substantially horizontal retort according to claim 6 wherein said heat means includes auxiliary combustion means for providing sufficient heat, in addition to combustion of said pyrolysis residue, to pyrolyze said carbonaceous material in said retort zone.

8. A substantially horizontal retort according to claim 6 wherein said stoker grate means includes a horizontal conveyor belt disposed beneath said retort tube wherein said belt conveyor belt is a mesh belt having mesh openings sufficiently large to allow passage of combustion gas up through said mesh belt, and sufficiently small to prevent substantial amounts of said pyrolysis residue from falling down through said mesh belt.

9. A substantially horizontal retort according to claim 7 wherein said solids waste removal means includes waste conveyor means disposed below said stoker grate for receiving waste solids from the stoker grate below the retort tube upstream and conveying the shale ash horizontally to below the retort tube downstream end and means for transferring said waste solids from the waste conveyor means at the retort tube downstream end to the outside of said horizontal retort.

10. A substantially horizontal retort according to claim 6 wherein said solids removal means includes a pyrolysis residue removal port for removing all or part of said pyrolysis residue from said retort tube without passing said pyrolysis residue to said stoker grate means whereby pyrolysis residues not having residual carbonaceous material thereon may be passed out of said retort without being conveyed on said stoker grate means.

11. An efficient retorting system for the processing of combined tar sands and oil shale comprising:

a generally transversely extending retort, having an input end and output end;

means including a screw conveyor for positively moving the combined oil shale and tar sands from the input end to the output end of said retort;

means including mixing bars extending between adjacent turns of said screw conveyor adjacent the periphery thereof, for positively mixing said tar sands and oil shale, as they are moved through aid retort;

fire box means substantially enclosing said retort and means therein for receiving carbonaceous residue from said output end of said retort and for combusting it to heat said retort;

additional burner means for heating said fire box; and means for varying the heat output from said additional burner means as the composition of the tar sands and oil shale supplied to said retort, and the amount of combustible residue from said retort varies, to maintain the temperature of said retort equal to or above the pyrolysis temperature for driving off the desired product gases from said tar sands and/or oil shale.

12. A retorting system according to claim 11, wherein said residue receiving means includes travelling grate means located beneath said retort for conveying said carbonaceous residue under said retort as it is being combusted to supply heat to said retort.

13. A retorting system according to claim 12 wherein means are provided for transferring hot flue gases generated during combustion of said carbonaceous residue to the interior of said retort to directly contact said tar sands and oil shale.

14. A method for retorting carbonaceous materials in a horizontal retort comprising the steps of:

introducing carbonaceous material including tar sands and oil shale into a substantially horizontal retort tube having a retort zone, said retort zone having an upstream end and a downstream end;

conveying said carbonaceous material substantially horizontally through said retort zone by a screw conveyor and simultaneously mixing said oil shale and tar sands included in said carbonaceous material;

heating said carbonaceous material in said retort zone to a temperature sufficient to pyrolyze said carbonaceous material to form product gasea and oil and pyrolysis residue;

conveying the pyrolysis residue substantially horizontally beneath said retort zone while combusting any carbonaceous material in said pyrolysis residue to produce at least a portion of the heat for heating said retort tube, said combustion also producing hot waste solids; and removing said waste solids.

15. A method according to claim 14 wherein longitudinal mixing bars are provided to additionally mix the oil shale and tar sands as they are conveyed through said retort.

* * * * *